US010161362B2

(12) United States Patent
Zhang

(10) Patent No.: US 10,161,362 B2
(45) Date of Patent: Dec. 25, 2018

(54) SYSTEMS AND METHODS FOR AN EXHAUST GAS RECIRCULATION MIXER

(71) Applicant: Ford Global Technologies, LLC, Dearborn, MI (US)

(72) Inventor: Xiaogang Zhang, Novi, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 9 days.

(21) Appl. No.: 15/250,108

(22) Filed: Aug. 29, 2016

(65) Prior Publication Data

US 2018/0058388 A1 Mar. 1, 2018

(51) Int. Cl.
*F02M 26/19* (2016.01)

(52) U.S. Cl.
CPC ..... *F02M 26/19* (2016.02)

(58) Field of Classification Search
CPC ..... F02M 26/19
USPC ..... 123/568.12–568.15, 568.17
See application file for complete search history.

(56) References Cited

U.S. PATENT DOCUMENTS 4,845,952 A 7/1989 Beebe
7,032,578 B2 4/2006 Liu et al.
7,552,722 B1 * 6/2009 Shieh ..... F02M 26/19 123/568.17
8,056,340 B2 11/2011 Vaught et al.
2002/0088443 A1 * 7/2002 Marthaler ..... F02M 26/19 123/568.17
2006/0060172 A1 * 3/2006 Liu ..... F02M 35/10118 123/568.17
2014/0077400 A1 * 3/2014 Sampath ..... B01F 5/0473 261/74
2015/0047330 A1 * 2/2015 Zhang ..... F01N 3/02 60/311
2015/0240753 A1 * 8/2015 Wilkinson ..... F02M 26/12 123/568.17
2017/0128894 A1 * 5/2017 Zhang ..... B01F 5/0602
2017/0138243 A1 * 5/2017 Zhang ..... F01N 3/2892
2017/0167951 A1 * 6/2017 Zhang ..... G01M 15/102
2017/0226916 A1 * 8/2017 Zhang ..... F01N 11/007

FOREIGN PATENT DOCUMENTS

EP 1681514 A2 7/2006

OTHER PUBLICATIONS

Zhang, Xiaogang, "Mixer for Mixing Exhaust Gas," U.S. Appl. No. 15/058,743, filed Mar. 2, 2016, 48 pages.

* cited by examiner

*Primary Examiner* — John Kwon
*Assistant Examiner* — Johnny H Hoang
(74) *Attorney, Agent, or Firm* — Julia Voutyras; McCoy Russell LLP

(57) ABSTRACT

Methods and systems are provided for a mixer. In one example, a system may include an EGR mixing having a downstream surface with a plurality of venturi tubes extending therefrom.

7 Claims, 5 Drawing Sheets

SYSTEMS AND METHODS FOR AN EXHAUST GAS RECIRCULATION MIXER

FIELD

The present description relates generally to methods and systems for an EGR mixer.

BACKGROUND/SUMMARY

Engine systems may utilize recirculation of exhaust gas from an engine exhaust system to an engine intake system, a process referred to as exhaust gas recirculation (EGR), to reduce regulated emissions. Traditionally, the amount of EGR routed through the EGR system is measured and adjusted based on engine speed, engine temperature, and load during engine operation to maintain desirable combustion stability of the engine while providing emissions and fuel economy benefits. Such EGR systems can reduce engine knock, in-cylinder heat losses, throttling losses, as well as NOx emissions. However, providing a desired engine dilution assumes an even distribution of EGR gas across engine intake air to maintain desirable combustion stability. From this, the performance of the engine EGR is largely determined by the flow mixing between intake air and EGR flow. A traditional "Y" shaped design of EGR mixers may be utilized to separate and distribute EGR flow into the intake passage.

Other attempts to address EGR mixing include expelling EGR gas from an EGR outlet into a venturi throat in an intake passage. One example approach is shown by Vaught et al. in U.S. Pat. No. 8,056,340. Therein, an annular EGR outlet is fluidly coupled to an intake passage directly downstream of a venturi throat of a venturi passage. The venturi passage comprises a protrusion adjacent the venturi throat to create an intake air turbulence to increase EGR mixing.

However, the inventors herein have recognized potential issues with such designs. As one example, EGR may not adequately mix with intake flowing through the intake passage. Consequently, a discrepancy between the concentration of EGR and intake air may lead to stratified distribution and non-uniformed temperature distribution, compromising the air/fuel mixture flowing into the engine intake for combustion.

In one example, the issues described above may be addressed by a system for a surface, such as a rounded surface, upstream of an engine and downstream of an EGR outlet, the surface comprising a plurality of venturi tubes extending in an upstream direction, where the venturi tubes are configured to receive intake air and EGR upstream of the surface and expel intake air and EGR downstream of the surface. In this way, intake air and exhaust gas flow through the venturi tubes before flowing through the circular surface.

As one example, intake air and exhaust gas are forced to flow through the venturi tubes before flowing to the engine. The surface, which may be circular in one example, may be impervious to and blocks gas flow. The mixer may be hollow and allow intake air and exhaust gas to flow between the venturi tubes. As gas flows through the venturi tubes, a vacuum is generated in the venturi tubes at a constriction of the venturi passages. Openings are located at the constriction of the venturi passages and as a result, vacuum from the venturi passages is provided to spaces between the venturi tubes. As such, gas may flow into the venturi tubes via a venturi inlet of through the openings. Intake gas and exhaust gas may mix in the venturi tubes or in the spaces between the venturi tubes, before flowing through the circular surface via venturi outlets. The homogeneity of intake air and exhaust gas is increased, which may result in improved engine performance.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2-5 are shown approximately to scale.

DETAILED DESCRIPTION

Figure 1:
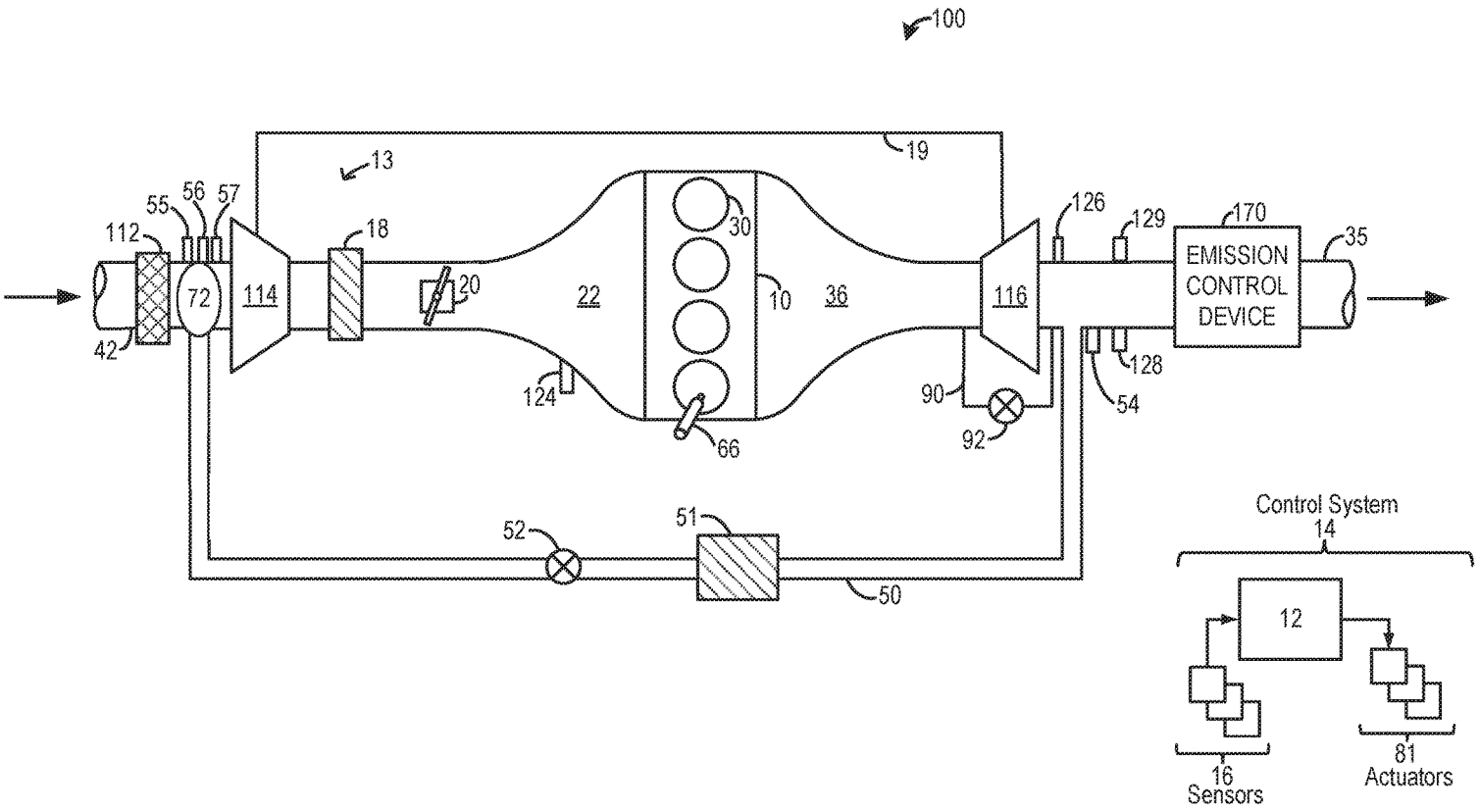
FIG. 1 shows an engine schematic.
Figure 2:
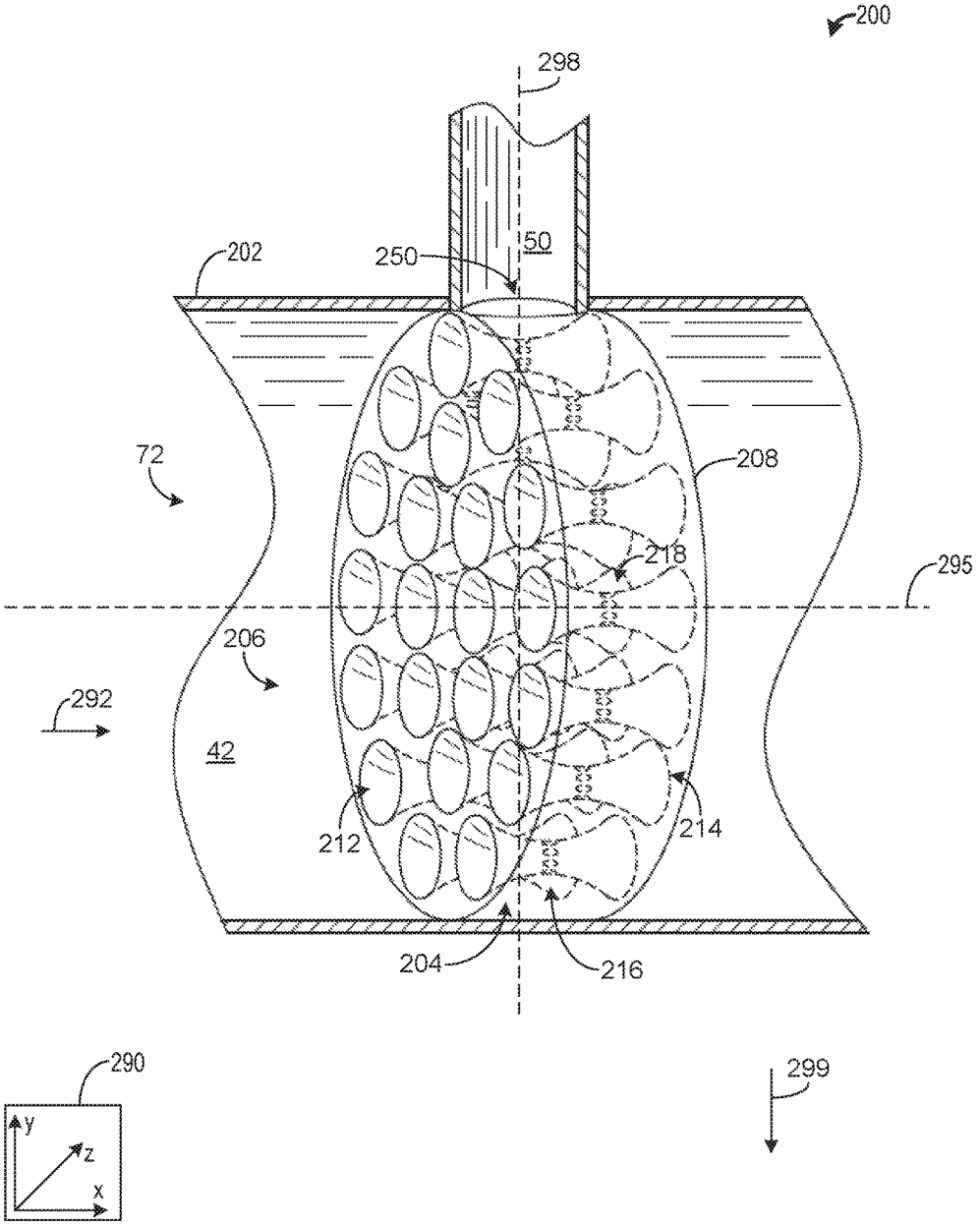
FIG. 2 shows a side-on isometric view of an EGR mixer.
Figure 3A:
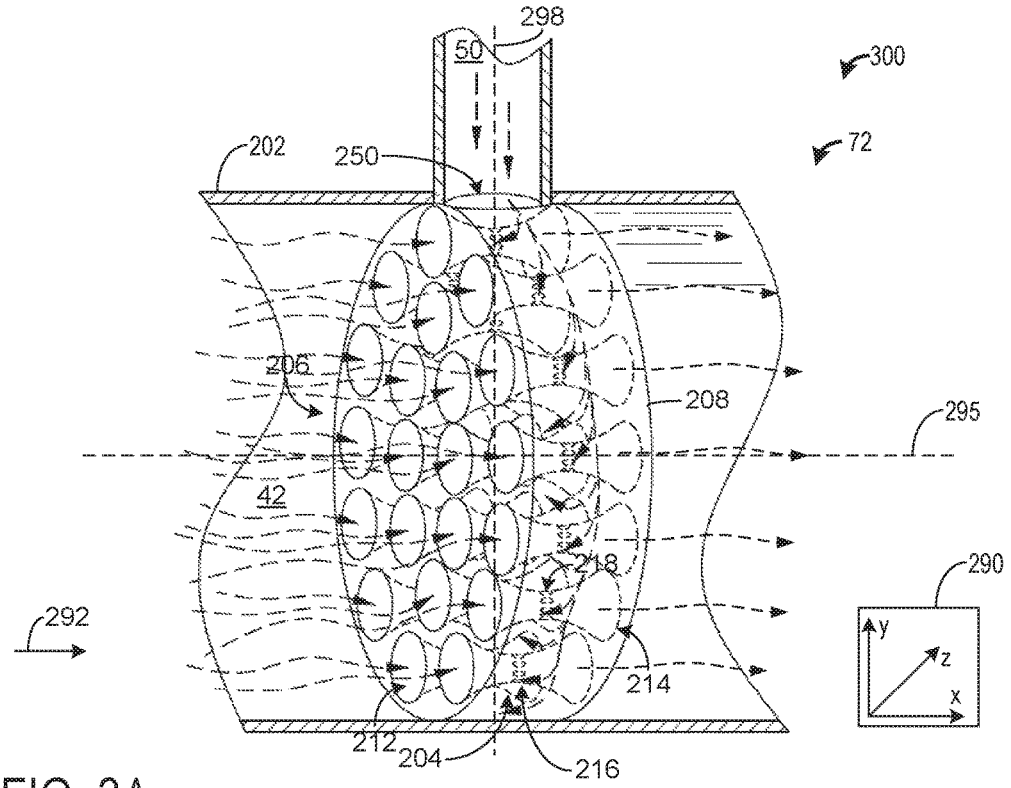
FIGS. 3A and 3B show an example intake air and EGR flow through a first embodiment of the mixer.
Figure 3B:
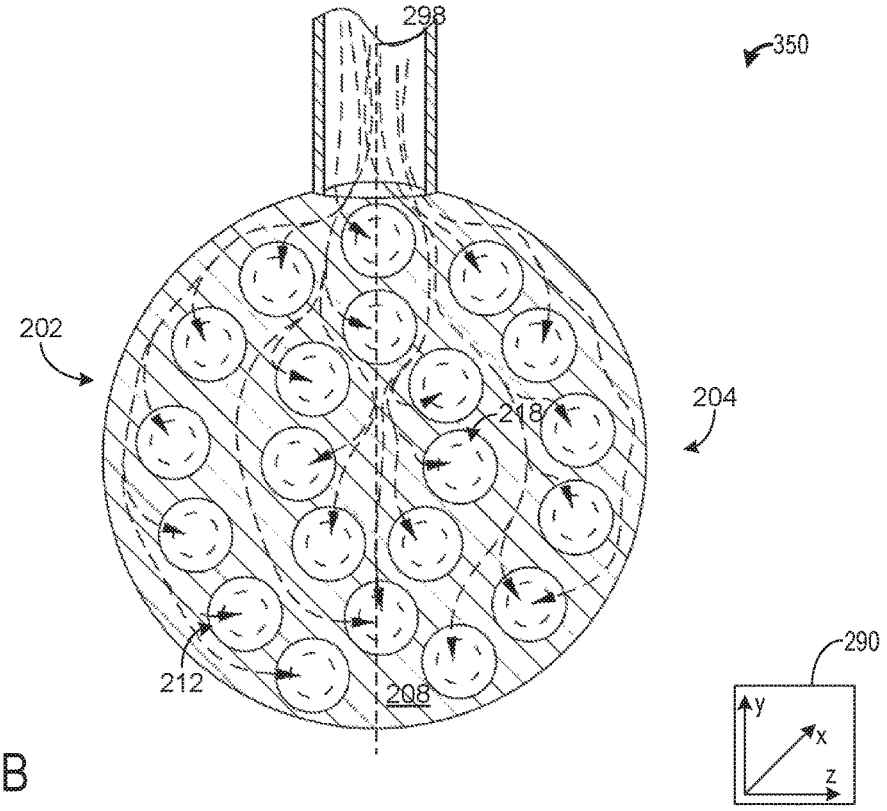
Figure 4A:
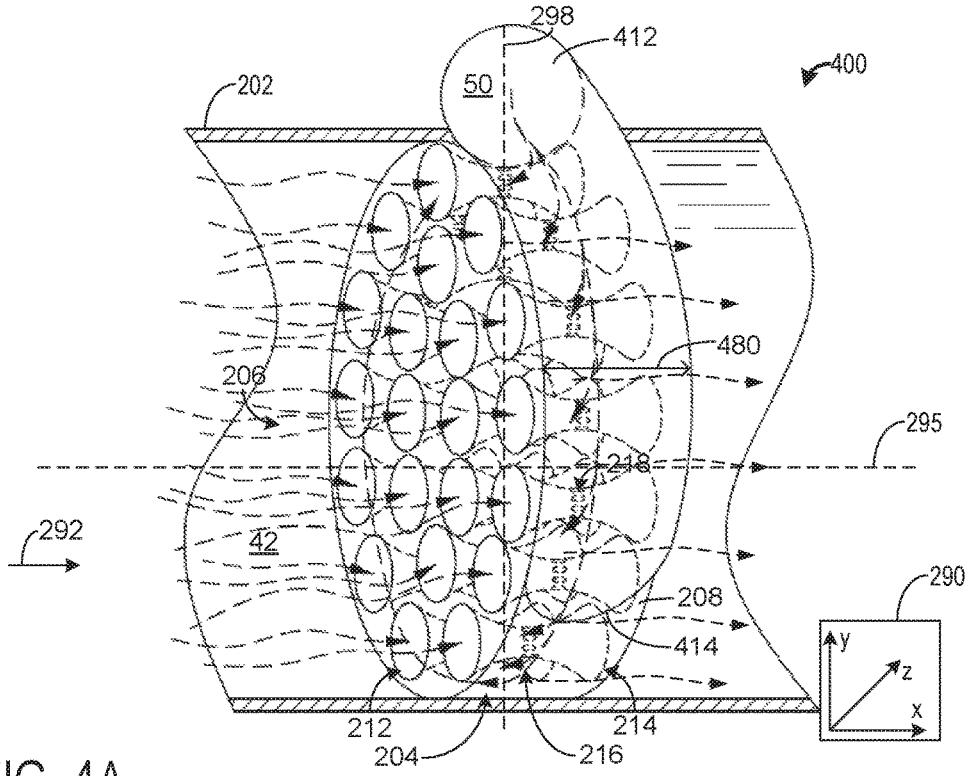
FIGS. 4A and 4B show an example intake air and EGR flow through a second embodiment of the mixer.
Figure 4B:
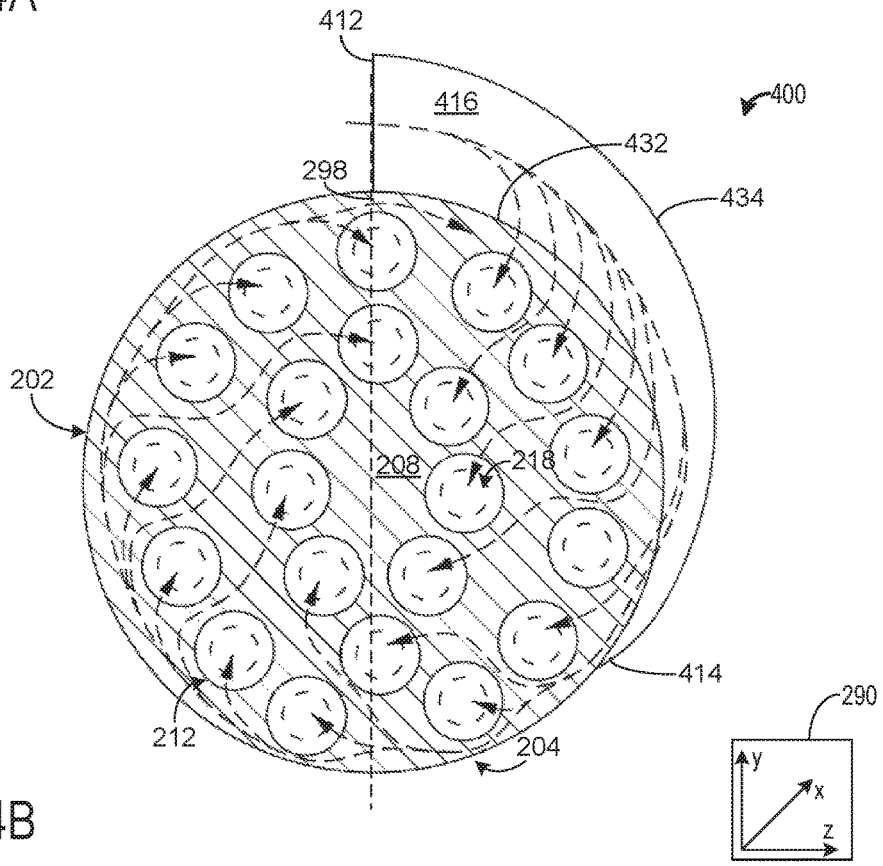
Figure 5:
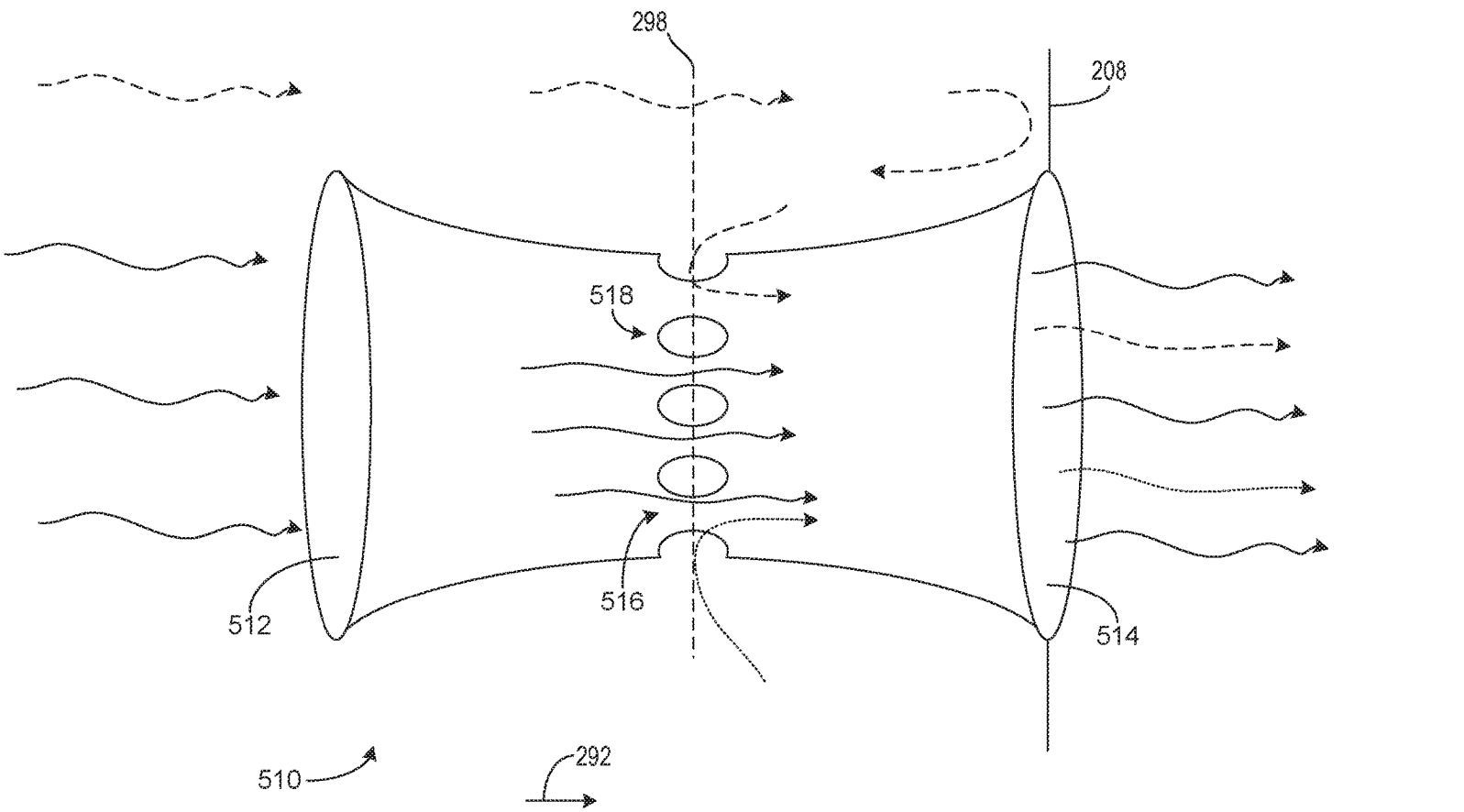
FIG. 5 shows a detailed via of EGR and intake air flowing through a venturi tube of the mixer.

The following description relates to systems and methods for an EGR mixer. In one example, the EGR mixer may be configured to mix both high-pressure and low-pressure EGR flows. As shown in FIG. 1, the mixer is fluidly coupled to an outlet of a low-pressure EGR passage. The mixer is located at a junction between an EGR passage and an intake passage. The mixer includes a circular surface in the intake passage downstream of an outlet of the EGR passage. The circular surface includes a plurality of venturi tubes for mixing intake air with exhaust gas, while also allowing the intake air and exhaust gas to flow through the circular surface, as shown in FIG. 2. Intake air flow is parallel to venturi passages of the venturi tubes while exhaust gas flow from the EGR outlet is perpendicular to the venturi tubes, as shown in FIGS. 3A and 3B. The EGR outlet may be altered such that it promotes EGR gas to swirl as it flows into the mixer, as shown in FIGS. 4A and 4B. The venturi tubes comprise a plurality of perforations around a venturi throat for sucking gas into the venturi tubes, as shown in FIG. 5.

FIGS. 1-5 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

FIG. 1 schematically shows aspects of an example engine system 100 including an engine 10. In the depicted embodiment, engine 10 is a boosted engine coupled to a turbocharger 13 including a compressor 114 driven by a turbine 116. Specifically, fresh air is introduced along intake passage 42 into engine 10 via air cleaner 112 and flows to compressor 114. The compressor 114 may be any suitable intake-air compressor, such as a motor-driven or driveshaft driven supercharger compressor. In engine system 10, however, the compressor is a turbocharger compressor mechanically coupled to turbine 116 via a shaft 19, the turbine 116 driven by expanding engine exhaust. In one embodiment, the turbocharger may be a twin scroll device. In another embodiment, the turbocharger may be a variable geometry turbocharger (VGT), where turbine geometry is actively varied as a function of engine operating conditions.

As shown in FIG. 1, compressor 114 is upstream of throttle valve 20 with charge-air cooler (CAC) 18 (herein also referred to as an intercooler) located therebetween. Throttle valve 20 is coupled to engine intake manifold 22. From the compressor 114, the compressed air charge flows through the charge-air cooler 18 and the throttle valve 20 to the intake manifold 22. The charge-air cooler 18 may be an air-to-air or water-to-air heat exchanger, for example. In the embodiment shown in FIG. 1, the pressure of the air charge within the intake manifold is sensed by manifold air pressure (MAP) sensor 124.

One or more sensors may be coupled to an inlet of compressor 114. These sensors may include, for example, a compressor inlet temperature sensor 55, a compressor inlet pressure (CIP) sensor 56, as well as a compressor inlet humidity sensor 57. The sensors may estimate a condition of the intake air received at the compressor inlet from the intake passage as well as the aircharge recirculated from upstream or downstream of the CAC. In addition, when EGR is enabled, the sensors may estimate a temperature, pressure, humidity, and air-fuel ratio of the aircharge mixture including fresh air, recirculated compressed air, and exhaust residuals received at the compressor inlet. Still other sensors may include, for example, air-fuel ratio sensors, pressure sensors, etc. In other examples, one or more of the compressor inlet conditions (such as humidity, temperature, etc.) may be inferred based on engine operating conditions.

During selected conditions, such as during a tip-out, when going from engine operation with boost to engine operation without boost, compressor surge can occur. This is due to a decreased flow through the compressor when the throttle closes at the tip-out. The reduced forward flow through the compressor can cause surge and degrade turbocharger performance. In addition, surge can lead to NVH issues such as undesirable noise from the engine intake system. To reduce compressor surge, at least a portion of the aircharge compressed by compressor 114 may be recirculated to the compressor inlet. This allows excess boost pressure to be substantially immediately relieved.

During a tip out wastegate actuator 92 may be actuated open to dump at least some exhaust pressure from upstream of the turbine 116 to a location downstream of the turbine via wastegate 90. By reducing exhaust pressure upstream of the turbine 116, turbine speed can be reduced.

Intake manifold 22 is coupled to a series of combustion chambers 30 through a series of intake valves (not shown). The combustion chambers are further coupled to exhaust manifold 36 via a series of exhaust valves (not shown). In the depicted embodiment, a single exhaust manifold 36 is shown. However, in other embodiments, the exhaust manifold may include a plurality of exhaust manifold sections. Configurations having a plurality of exhaust manifold sections may enable effluent from different combustion chambers to be directed to different locations in the engine system.

In one embodiment, each of the exhaust and intake valves may be electronically actuated or controlled. In another embodiment, each of the exhaust and intake valves may be cam actuated or controlled. Whether electronically actuated or cam actuated, the timing of exhaust and intake valve opening and closure may be adjusted as needed for desired combustion and emissions-control performance.

Combustion chambers 30 may be supplied one or more fuels, such as gasoline, alcohol fuel blends, diesel, biodiesel, compressed natural gas, etc. Fuel may be supplied to the combustion chambers via direct injection, port injection, throttle valve-body injection, or any combination thereof. In the combustion chambers, combustion may be initiated via spark ignition and/or compression ignition.

As shown in FIG. 1, exhaust from the one or more exhaust manifold sections is directed to turbine 116 to drive the turbine. When reduced turbine torque is desired, some exhaust may be directed instead through wastegate 90, by-passing the turbine. The combined flow from the turbine and the wastegate then flows through emission control 170. In general, one or more emission control devices 170 may include one or more exhaust after-treatment catalysts configured to catalytically treat the exhaust flow, and thereby reduce an amount of one or more substances in the exhaust flow. For example, one exhaust after-treatment catalyst may be configured to trap NOx from the exhaust flow when the exhaust flow is lean, and to reduce the trapped NOx when the exhaust flow is rich. In other examples, an exhaust after-treatment catalyst may be configured to disproportionate NOx or to selectively reduce NOx with the aid of a reducing agent. In still other examples, an exhaust after-treatment catalyst may be configured to oxidize residual hydrocarbons and/or carbon monoxide in the exhaust flow. Different exhaust after-treatment catalysts having any such functionality may be arranged in wash coats or elsewhere in the exhaust after-treatment stages, either separately or together. In some embodiments, the exhaust after-treatment stages may include a regeneratable soot filter configured to trap and oxidize soot particles in the exhaust flow.

All or part of the treated exhaust from emission control 170 may be released into the atmosphere via exhaust conduit 35. Depending on operating conditions, however, some exhaust may be diverted instead to EGR passage 50, through EGR cooler 51 and EGR valve 52, to the inlet of compressor 114. The EGR valve 52 may be opened to admit a controlled amount of cooled exhaust gas to the compressor inlet for desirable combustion and emissions-control performance. In this way, engine system 10 is adapted to provide external, low-pressure (LP) EGR by tapping exhaust gas from downstream of turbine 116. Further, the disposition of EGR take-off and mixing points provides very effective cooling of the exhaust gas for increased available EGR mass and improved performance. In further embodiments, the engine system may further include a high pressure EGR flow path wherein exhaust gas is drawn from upstream of turbine 116 and recirculated to the engine intake manifold, downstream of compressor 114.

Intake air and exhaust gas homogeneity may be increased upstream of the compressor 114 via a mixer 72. The mixer 72 comprises features located adjacent an interface between the EGR passage 50 and the intake passage 42 to promote mixing between the exhaust gas and intake passage. In some examples, the interface may be shaped to further promote mixing between the exhaust gas and intake air. In this way, each of the combustion chambers 30 may receive a substantially identical amount and composition of an intake air and exhaust gas mixture. This may improve combustion stability and reduce vehicle emissions compared to vehicles lacking a mixer.

EGR cooler 51 may be coupled to EGR passage 50 for cooling EGR delivered to the compressor. In addition, one or more sensors may be coupled to EGR passage 50 for providing details regarding the composition and condition of the EGR. For example, a temperature sensor may be provided for determining a temperature of the EGR, a pressure sensor may be provided for determining a pressure of the EGR, a humidity sensor may be provided for determining a humidity or water content of the EGR, and an air-fuel ratio sensor 54 may be provided for estimating an air-fuel ratio of the EGR. An opening of the EGR valve may be adjusted based on the engine operating conditions and the EGR conditions to provide a desired amount of engine dilution.

Engine system 100 may further include control system 14. Control system 14 is shown receiving information from a plurality of sensors 16 (various examples of which are described herein) and sending control signals to a plurality of actuators 81 (various examples of which are described herein). As one example, sensors 16 may include exhaust gas sensor 126 located upstream of the emission control device, MAP sensor 124, exhaust temperature sensor 128, exhaust pressure sensor 129, compressor inlet temperature sensor 55, compressor inlet pressure sensor 56, compressor inlet humidity sensor 57, and EGR sensor 54. Other sensors such as additional pressure, temperature, air/fuel ratio, and composition sensors may be coupled to various locations in engine system 100. The actuators 81 may include, for example, throttle 20, EGR valve 52, wastegate actuator 92, and fuel injector 66. The control system 14 may include a controller 12. The controller may receive input data from the various sensors, process the input data, and trigger various actuators in response to the processed input data based on instruction or code programmed therein corresponding to one or more routines.

FIG. 2 shows an isometric view 200 of the mixer 72 positioned along intake passage 42 within an intake pipe 202. As such, components previously introduced may be similarly numbered in subsequent figures. The mixer 72 is configured to receive intake air via the intake passage 42 along with exhaust gas via EGR passage 50. It will be appreciated that the mixer 72 may not receive EGR gas when an EGR valve (e.g., EGR valve 52) is in a fully closed position. As such, the mixer 72 may operate as an intake air mixer when EGR flow is shut-off. The mixer 72 is fixed in the intake passage 42 to interior surfaces of the intake pipe 202 and may not be coupled to mechanical or electronic actuators.

An axis system 290 is shown comprising three axes, an x-axis in the horizontal direction, a y-axis in the vertical direction, and a z-axis in a direction perpendicular to both the x and y axes. A central axis 295 of the intake pipe 202 is shown by a dashed line. The central axis 295 passes through a geometric center of the mixer 72. As such, the central axis 295 may function as a horizontal central axis 295 for the mixer 72. A vertical axis 298 is shown passing through the geometric center of the mixer 72 perpendicularly to central axis 295. The vertical axis 298 is a vertical central axis of the EGR passage 50. Thus, the EGR passage 50 perpendicularly intersects the intake pipe 202 at the mixer 72. A direction of gravity is shown via arrow 299, which is parallel to the vertical axis 298. A direction of incoming intake air flow is shown via arrow 292, which is parallel to the central axis 295.

The mixer 72 may be a contiguous, single machined piece. Alternatively, the mixer 72 may be a plurality of pieces welded, fused, or coupled together via other suitable coupling elements (e.g., adhesives). The mixer 72 may be composed of durable, light-weight materials suitable withstanding high gas flow rates and high gas temperatures. As an example, the mixer 72 may be composed of one or more of a ceramic material, metal alloy, a silicon derivative, or other suitable material capable of meeting the conditions described above. Additionally or alternatively, the mixer 72 may comprise coatings configured to decrease an amount of soot and/or debris depositing on the mixer 72.

The mixer 72 is cylindrical with a circular cross-section emulating a shape of intake pipe 202. Thus, it will be appreciated that the geometrical features of the mixer 72 may be altered to resemble the features of an intake pipe without departing from the scope of the present disclosure. As such, a cross-section of the mixer 72 may be triangular, rectangular, square-like, etc.

In some examples, the mixer 72 may comprise an outer annular wall 204 substantially equal to the intake pipe 202 in diameter such that an outer surface of the outer annular wall 204 is pressed against (in abutment with) an interior surface of the intake pipe 202. In one example, the mixer 72 is forcibly slid into the intake passage 42. In another example, the outer annular wall 204 is welded, fused, and/or coupled to the intake pipe 202 via adhesives. Additionally or alternatively, the outer annular wall 204 may be flush against the intake pipe 202. As shown, the intake pipe 202 and outer annular wall 204 comprise opening 250 for admitting EGR from the EGR passage 50 to the mixer 72 and/or intake passage 42. In some embodiments, additionally or alternatively, the mixer 72 may not comprise the outer annular wall 204. As such, the intake pipe 202 may form an outer annular edge of the mixer 72 and comprise the features of the outer annular wall 204 described below without departing from the scope of the present disclosure.

The mixer 72 further comprises an upstream face 206 and downstream face 208 with respect to the direction of incoming intake air flow 292. The upstream face 206 includes an upstream edge of the outer annular wall 204 and is completely open such that incoming intake air may flow uninterruptedly therethrough, in one example.

Alternatively, the downstream face 208 is a circular surface (e.g., a plate) physically coupled to a downstream edge of the outer annular wall 204, in one example. Thus, the downstream face 208 of the mixer 72 is not permeable and intake air and/or EGR do not flow directly through the downstream face 208. As such, the downstream face 208 may also be referred to herein as downstream surface 208. Welds, adhesives, fusions, and/or other coupling elements may be used to fix the downstream surface 208 to the outer annular wall 204. Alternatively, the downstream surface 208 may physically couple to interior surfaces of the intake pipe 202 downstream of the opening 250. A width of the downstream surface 208 along the x-axis may be relatively small (e.g., less than 1 centimeter) to reduce a weight of the mixer 72.

A plurality of venturi tubes 210 extend from the downstream surface 208 in an upstream direction, opposite arrow 292, toward the upstream face 206. The venturi tubes 210 are substantially identical to each other with their venturi passages being substantially parallel to the direction of incoming intake air flow. A length of the venturi tubes 210 is substantially equal to a diameter of the opening 250. In some examples, the venturi tubes 210 are shorter or longer than the diameter of the opening 250.

The venturi tubes 210 comprise venturi inlets 212, venturi outlets 214, and venturi throats 216. The venturi inlets 212 may be uncoupled and parallel to vertical axis 298 along a plane of the upstream face 206. The venturi outlets 214 may be coupled to the downstream surface 208 via welds, fusions, adhesives, and/or other suitable coupling elements. As such, while the downstream surface 208 is impervious to intake air and exhaust gas flow, the venturi tubes 210 are configured to allow passage of intake air and exhaust gas through the downstream surface 208. Therefore, the downstream surface 208 may comprise a plurality of openings corresponding to each of the venturi tubes 210 such that intake air may flow through the venturi tubes 210, passed the downstream face 208, and toward an engine (e.g., engine 10 of FIG. 1). Alternatively or additionally, the venturi tubes 210 may be physically coupled to the downstream surface 208 at a location between a venturi throat and venturi outlet. In one example, intake air only flows through the downstream surface 208 via the venturi tubes 210. As such, intake air does not directly flow through the downstream surface 208 and does not flow between the downstream surface 208 and intake pipe 202.

The venturi tubes 210 are arranged concentrically and radially spaced about the central axis 295. Thus, the venturi tubes 210 are organized symmetrically about the vertical axis. As such, the venturi tubes 210 are evenly spaced about the central axis 295 with a first group adjacent the central axis 295 and a second group adjacent the intake pipe 202. Therefore, the second group is located more radially outwardly from the central axis 295 then the first group. By symmetrically distributing the venturi tubes 210, vacuum generated by the venturi tubes 210 may be evenly distributed through the mixer 72. In this way, intake air and exhaust gas flow may be evenly distributed through the intake passage 42. However, it will be appreciated that the venturi tubes 210 may be unorganized and unevenly distributed along the upstream surface of the downstream face 208 without departing from the scope of the present disclosure. For example, a greater number of venturi tubes may be located at a lower portion of the mixer 72. This may promote a greater amount of intake air and exhaust gas to flow through the intake passage at a location near the lower portion.

The venturi tubes 210 are hollow with venturi inlets 212 and venturi outlets 214, as described above. The venturi tubes 210 constrict between the venturi inlets 212 and venturi outlets 214 with venturi throats 216 corresponding to an area of greatest restriction in the venturi tubes 210. Therefore, a diameter of the venturi tubes 210 decreases from the venturi inlets 212 to the venturi throats 216, reaching a minimum diameter at the throats, before increasing from the venturi throats 216 to the venturi outlets 214. In one example, the venturi throats 216 are located exactly halfway between the venturi inlets 212 and venturi outlets 214, aligned with the vertical axis 298. In this way, the venturi tubes 210 are aligned with the opening 250 of the EGR passage 50. Therefore, intake air flow is parallel to the venturi tubes 210 and exhaust gas flow is perpendicular to the venturi tubes 210. This may cause increased turbulence and/or swirling, thereby increasing a homogeneity of intake air and exhaust gas at the mixer 72.

To promote intake air and/or exhaust gas flow through the venturi tubes 210, the venturi tubes 210 further comprise a plurality of perforations 218 located at the venturi throats 216. The perforations 218 are substantially identical to one another. The perforations 218 may be circular, oblong, triangular, or other shape. In one example, the perforations 218 are circular and located around an entire circumference of the venturi throats 216. The perforations 218 fluidly couple the venturi throats 216 to the intake passage 42. In this way, vacuum generated at the venturi throats 216, as intake air passes therethrough, may be supplied to the intake passage 42 to suck in intake air and/or exhaust gas outside of the venturi tubes 210 near the perforations 218. Therefore, intake air and/or exhaust gas may enter the venturi tubes 210 by flowing through the perforations 218, without flowing through the venturi inlets 212. Intake air flow through the mixer 72 will be described in greater detail below.

Thus, FIG. 2 shows a system of a mixer comprising a circular surface upstream of an engine and downstream of an EGR outlet, the surface comprising a plurality of venturi tubes extending in an upstream direction, the venturi tubes configured to receive intake air and EGR upstream of the surface and expel intake air and EGR downstream of the surface. The venturi tubes comprise venturi inlets, venturi outlets, and venturi throats, and where the circular surface is physically coupled to the venturi tubes at the venturi outlets. Each of the venturi tubes comprises a plurality of perforations located around a venturi throat. The circular surface is in sealing contact with an interior surface of an intake pipe, and where the surface is impervious to gas flow. Thus, intake gas and EGR cannot flow through the circular surface without flowing through a venturi tube of the venturi tubes. In this way, intake gas and/or EGR that does not enter the venturi tubes via the venturi inlets may enter the venturi tubes via the perforations located around the venturi throats. This not only forces a directional change of gas flow, but may also increase intake air and EGR turbulence, thereby increasing EGR mixing with intake air.

Turning now to FIGS. 3A and 3B, they show example intake air and EGR flows through the mixer from side-on and face-on views, respectively. Specifically, FIG. 3A shows isometric view 300, which is the same isometric view illustrated in FIG. 2, while FIG. 3B shows a face-on view 350 of the mixer 72. The intake air and EGR flows depicted are example flows for the mixer 72. FIGS. 3A and 3B both comprise axis system 290. However, the axis system 290 has been rotated to match the perspective shown in FIG. 3B.

FIG. 3A shows intake air, via dashed line arrows, flowing from a left side to a right side of the figure. EGR gas flow, also indicated via dashed line arrows, flows in a plane parallel to the vertical axis 298 and the y- and z-axes. As such, the EGR gas flow is shown flowing in a downward direction in the figure. The EGR gas enters the mixer 72, from EGR passage 50 via the opening 250, in a direction substantially perpendicular to a direction of intake air (arrow 292) before flowing into or between the venturi tubes 210. As intake air flows through the venturi tubes 210, vacuum generated at the venturi throats 216 is able to suck EGR and/or intake air flow through the perforations 218 and into the venturi tubes 210. In this way, EGR may flow down or around the venturi tubes 210 and mix with intake air outside of the venturi tubes 210, before flowing into the venturi tubes 210 to mix with intake air inside the venturi tubes 210. Said another way, intake air and EGR may swirl around the venturi tubes 210 upstream of the downstream surface 208 until the intake air and/or EGR are/is adjacent the perforations 218 of the venturi tubes 210. Gas flowing through the perforations 218 flows in a direction perpendicular to a direction of gas flow flowing through the venturi inlets 212 (e.g., which is parallel to arrow 292). Arrows to the right of the mixer 72 shows intake air and/or EGR flows exiting the venturi tubes 210 via the venturi outlets 214. As described above, air does not flow through the downstream surface 208 without flowing through the venturi outlets 214. As such, the venturi tubes 210 fluidly coupled a portion of intake passage 42 upstream of the mixer 72 to a portion of intake passage 42 downstream of the mixer 72.

FIG. 3B shows EGR gas flowing into the mixer 72 along the vertical axis 298. As the EGR enters the mixer 72, a portion of the EGR begins to flow into spaces located between the venturi tubes 210. Intake air that has entered the mixer 72 and has not flowed into the venturi tubes 210 (e.g., flows into the mixer 72 and collides with the downstream face 208) may also be located in the spaces between the venturi tubes 210. Thus, EGR and intake air may mix outside of the venturi tubes 210 within the mixer 72. A remaining portion of the EGR enters the venturi tubes 210 via the perforations 218 or venturi inlets 212. In one example, more EGR enters the venturi tubes 210 via the perforations 218 than the venturi inlets 212. This may occur as intake air flows through the venturi tubes 210, creating low static pressure at the venturi throats 216, and draws in EGR and/or intake air into the mixer 72 from the spaces between the venturi tubes 210. In this way, a mixture of intake air and EGR may flow out of the venturi outlets 214 and into the portion of the intake passage 42 downstream of the downstream surface 208. Due to the organization of the venturi tubes as described above, the mixture may flow adjacent the intake pipe or the central axis (e.g., intake pipe 202 and central axis 295 of FIGS. 2 and 3A). In this way, exhaust flow near the intake pipe may be substantially similar in composition to exhaust gas near the central axis of the intake pipe.

Turning now to FIGS. 4A and 4B, they show example intake air and EGR flows through a mixer 400 from side-on and face-on views, respectively. Specifically, FIG. 4A shows the same isometric view as illustrated in FIG. 2, while FIG. 4B shows a face-on view of the mixer 400. The mixer 400 is an alternate embodiment of the mixer 72. As such, components shared between the mixer 400 and the mixer 72 are numbered similarly below and may not be reintroduced. Furthermore, the mixer 400 may be used in intake pipe 202 of intake passage 42 shown in FIG. 2. The intake air and EGR flows depicted for the mixer 400 are example flows for the mixer 400. FIGS. 4A and 4B both comprise axis system 290. However, the axis system 290 has been rotated to match the perspective shown in FIG. 4B.

FIG. 4A shows the mixer 400 having a pipe 410 following a contour of the intake pipe 202. As such, the pipe 410 is referred to herein as the curved pipe 410. The curved pipe 410 is hollow and fluidly coupled to an outlet of the EGR passage 50. In one example, the curved pipe is contiguous with the EGR passage 50. As such, EGR flows into the curved pipe 410 before flowing into the mixer 400. The curved pipe 410 is located outside of the intake pipe 202 and/or outer annular wall 204, upstream of the downstream surface 208. The curved pipe 410 and the venturi tubes 210 are located along the vertical axis 298 between planes created by the upstream face 206 and downstream surface 208. Said another way, neither the curved pipe 410 or venturi tubes 210 extend upstream of the upstream face 206 or downstream of the downstream surface 208. Additionally or alternatively, the EGR may flow along a circumference of the mixer 400 and/or intake pipe 202 in a spiral-shape or volute-shape toward central axis 295. In some examples, the outlet may be fluidly coupled to both the opening (e.g., opening 250 of FIG. 2) and the curved pipe 410. Thus, EGR may enter the mixer 72 via the opening and/or the curved pipe 410.

An inlet 412 of the curved pipe 410 is coupled to the outlet of an EGR passage (e.g., EGR passage 50 of FIGS. 1 and 2). As shown, the inlet 412 is circular, but may be other shapes depending on a geometry of the EGR outlet. A diameter of the inlet 412 may be a largest diameter of the curved pipe 410. Thus, the diameter of the curved pipe 410 decreases from the inlet 412 to an end point 414, as will be described below.

FIG. 4B shows the curved pipe 410 traversing a portion of the circumference of the outer annular wall 204. The curved pipe 410 spans less than half the circumference of the outer annular wall 204. More specifically, the curved pipe 410 traverses exactly one-third the circumference of the outer annular wall 204, in one example. The curved pipe 410 is volute-shaped, in one example. As shown, the curved pipe 410 involutes toward the outer annular wall 204. Therefore, a diameter and/or height of the curved pipe 410 gradually decreases from the inlet 412 to the end point 414. This may promote the curved EGR gas flow depicted in the figure. By curving the pipe 410 and therefore the EGR gas flow, a swirling effect within the mixer 400 may be introduced, which may enable increased mixing between EGR and intake air.

An interior passage 416 is fluidly coupled to the mixer 400. In one example, the interior passage 416 is completely open along an inner portion 432 of the curved pipe 410. Thus, EGR may freely flow from the curved pipe 410 to the mixer 400. Alternatively, the inner portion 432 is perforated and EGR may only flow out of the interior passage 416 via the perforations. Thus, an outer portion 434 of the curved pipe 410 is completely sealed. As a result, EGR may not flow directly from the interior passage 416 to the engine or an ambient atmosphere. Intake air flow may not flow into the curved pipe 410 due to a pressure of the mixer 400 being less than a pressure of the interior passage 416. This may be due to the venturi tubes 210 creating a vacuum in the mixer 400.

As shown, the EGR gas flows in a concentric direction toward a geometric center of the mixer 400. As the EGR flows toward the center of the mixer 400, vacuum from the venturi tubes 210 may draw in portions of the EGR. In this way, intake gas and EGR mix inside the venturi tubes 210 before exiting the mixer 400. Alternatively, EGR gas may mix with intake air outside of the venturi tubes 210. In this way, intake air may flow into the downstream surface 208 (shown by a striped filled circle) and then flow in the hollow spaces of the mixer 400 located between the venturi tubes 210. As such, the intake air and EGR may mix and then flow into a venturi tube of the venturi tubes 210 to mix with unmixed intake air. By doing this, a plurality of mixing mechanisms may be employed by the mixer 400 to promote the mixing of intake air and EGR to improve EGR distribution to engine cylinders. This may increase combustion stability, decrease emissions, and increase an engine longevity.

Thus, a method for a mixer may include mixing intake and exhaust gases via a plurality of venturi tubes arranged along a common vertical axis shared with an EGR passage comprising a curved outlet (e.g., curved pipe) spanning a portion of a circumference of a downstream wall to which the venturi tubes are fixed. The curved outlet is a volute shape and involutes toward an outer annular wall of the mixer. The downstream wall is impervious to gas and is in sealing contact with an interior surface of an intake pipe. The downstream wall fluidly separates a portion of an intake passage upstream of the wall from a portion of the intake passage downstream of the wall. The venturi tubes further comprise a plurality of perforations located at a venturi throat aligned with the common vertical axis. The venturi tubes supply vacuum to the mixer via the perforations to promote exhaust gas and intake air flow through the mixers. EGR flows into the venturi tubes via the perforations. The curved outlet decreases in height from an inlet to an end point, promoting a swirling effect as EGR enters the mixer.

Turning now to FIG. 5, it shows a detailed example 500 of a single venturi tube 510 of the venturi tubes 210. Example intake air and EGR flows are also shown. Intake air flowing directly into the venturi tube 510 is shown via solid line arrows. Intake air avoiding the venturi tube 510 and colliding with the downstream face 208 is shown via medium dashed arrows. EGR gas is shown via small dashed arrows. Medium dashes are bigger than small dashes.

Solid line arrows flow directly into the venturi tube 510 via a venturi inlet 512. Medium dash arrows flow into the downstream face 208 without flowing into the venturi tube 510. As shown, the medium dash arrows flow in a downstream direction, contact the downstream face 208, and begin to flow in an upstream direction opposite to its initial flow path. Therefore, the downstream face 208 prevents intake air from flowing to an engine (e.g., engine 10) without flowing through a venturi tube of the venturi tubes. Small dash arrows flow directly into the venturi tube 510 via perforations 518. As shown, the perforations 518 are aligned with vertical axis 298 along a venturi throat 516 of the venturi tube 510. It will be appreciated that the small dash arrows may not directly flow into the venturi tube 510, but rather, flow around the venturi tube 510 and merge with medium dash arrows. Medium dash arrows are also drawn into the venturi tube 510 via perforations 518 after the medium dash arrows have collided with the downstream face 208. Medium dash arrows and small dash arrows merge in the venturi throat 516 with solid line arrows before flowing out of a venturi outlet 514, passed the downstream face 208, and toward the engine.

In this way, a compact EGR mixer located at an intersection between an EGR passage and an intake passage may increase EGR mixing with intake air flow. The EGR mixer comprises a downstream face configured to impede gas flow to portions of the intake passage downstream of the downstream face. Venturi tubes protrude from the downstream face in an upstream direction and are configured to allow the passage of gases through the downstream face. Thus, the venturi tubes are the only avenue for flowing passed the downstream face, in one example. The technical effect of preventing gas flow via the downstream face is to increase mixing between intake gas and EGR. The EGR passage may directly flow EGR into the mixer or may flow EGR through a curved pipe into the mixer. The EGR is drawn into the venturi tubes as intake gas flows through a venturi throat, where a plurality of perforations are located for applying venturi vacuum to the EGR. Thus, the perforations fluidly couple the vacuum generated at the venturi throat to suck in the EGR gas. By doing this, EGR and intake gas mix upstream of the downstream face before flowing through the venturi tube and to an engine.

A system comprising a rounded surface upstream of an engine and downstream of an EGR outlet, where the surface comprising a plurality of venturi tubes extending in an upstream direction, and where the venturi tubes are configured to receive intake air and EGR upstream of the surface and expel intake air and EGR downstream of the surface. A first example of the system further includes where the surface is in sealing contact with an interior surface of an intake pipe, and where the surface is impervious to gas flow. A second example of the system, optionally including the first example, further includes where the venturi tubes comprise venturi inlets, venturi outlets, and venturi throats, and where the surface is circular and physically coupled to the venturi tubes at the venturi outlets. A third example of the system, optionally including the first and/or second examples, further includes where each of the venturi tubes comprises a plurality of perforations located around a venturi throat. A fourth example of the system, optionally including one or more of the first through third examples, further includes where the EGR outlet is curved and spans a portion of a circumference of an intake pipe. A fifth example of the system, optionally including one or more of the first through fourth examples, further includes where intake gas and EGR cannot flow through the surface without flowing through a venturi tube of the venturi tubes. A sixth example of the system, optionally including one or more of the first through fifth examples, further includes where the venturi tubes are parallel to a direction of incoming intake air flow and perpendicular to a direction of incoming EGR flow.

An EGR mixer comprising an outer annular wall in face-sharing contact with an interior surface of an intake pipe, an EGR passage fluidly coupled to a portion of an intake passage interior to the outer annular wall, and a downstream wall in sealing contact with the outer annular wall, the downstream wall further comprising a plurality of venturi tubes configured to allow gases to flow through the downstream wall. A first example of the EGR mixer further includes where the venturi tubes further comprise perforations located along venturi throats, and where the perforations and EGR passage are aligned along a vertical axis. A second example of the EGR mixer, optionally including the first example, further includes where the EGR passage comprises an outlet passage spanning an outer portion of the outer annular wall, where the outer annular wall and intake pipe comprise an opening spanning an entire length of the outlet passage. A third example of the EGR mixer, optionally including the first and/or second examples, further includes where the outlet passage is curved and spans less than half of a circumference of the outer annular wall. A fourth example of the EGR mixer, optionally including one or more of the first through third examples, further includes where the downstream wall blocks gas flow and fluidly separates the EGR mixer from a portion of the intake passage downstream of the downstream wall. A fifth example of the EGR mixer, optionally including one or more of the first through fourth examples, further includes where the venturi tubes fluidly couple the EGR mixer to a portion of the intake passage downstream of the downstream wall.

A method for a mixer comprising mixing intake and exhaust gases via a plurality of venturi tubes arranged along a common vertical axis shared with an EGR passage comprising a curved outlet spanning a portion of a circumference of a downstream wall to which the venturi tubes are fixed. A first example of the method further includes where the curved outlet is a volute shape and involutes toward an outer annular wall of the mixer. A second example of the method, optionally including the first example, further includes where the downstream wall is impervious to gas and is in sealing contact with an interior surface of an intake pipe. A third example of the method, optionally including the first and/or second examples, further includes where the venturi tubes further comprise a plurality of perforations located at a venturi throat aligned with the common vertical axis. A fourth example of the method, optionally including one or more of the first through third examples, further includes where flowing intake gas through the plurality of venturi tubes, where flowing intake gas through the venturi throat includes generating a vacuum provided to portions of the mixer via the perforations. A fifth example of the method, optionally including one or more of the first through fourth examples, further includes where EGR flows into the venturi tubes via the perforations. A sixth example of the method, optionally including one or more of the first through fifth examples, further includes where the curved outlet decreases in height from an inlet to an end point.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A gas mixing system comprising:

a first surface upstream relative to intake air flow of an engine and including inlets of a plurality of venturi tubes, the inlets of the venturi tubes receiving intake air, a second surface including outlets of the venturi tubes which expel intake air and EGR, perforations in venturi throats downstream in an EGR flow from a curved pipe extending in a circumferential direction relative to an intake pipe, and the venturi tubes extending between the first and second surfaces perpendicular to the circumferential direction of the curved pipe.

2. The gas mixing system of claim 1, wherein the first and second surfaces are in sealing contact with an interior surface of the intake pipe, and where the surfaces are impervious to gas flow.

3. The gas mixing system of claim 1, wherein the first and second surfaces fluidly connect the perforations, the curved pipe, and an EGR outlet.

4. The gas mixing system of claim 3, wherein the venturi throat provides vacuum to draw EGR through the perforations.

5. The gas mixing system of claim 1, wherein an EGR outlet is curved and spans a portion of a circumference of the intake pipe.

6. The gas mixing system of claim 1, wherein intake gas enters though the inlets of the venturi tubes in the first surface and EGR enters through the perforations, the intake gas and EGR mix in the venturi throats and exit through the outlets of the venturi tubes in the second surface.

7. The gas mixing system of claim 1, wherein the venturi tubes are parallel to a direction of incoming intake air flow and perpendicular to a direction of incoming EGR flow.

* * * * *